United States Patent [19]

Gergoe et al.

[11] Patent Number: 4,946,211

[45] Date of Patent: Aug. 7, 1990

[54] LATCH CONTROL ARRANGEMENT

[75] Inventors: Bela Gergoe, Birmingham; Joseph M. Osenkowski, Detroit, both of Mich.

[73] Assignee: General Motors Corporation, Detroit, Mich.

[21] Appl. No.: 342,267

[22] Filed: Apr. 24, 1989

[51] Int. Cl.[5] ..... E05B 3/00

[52] U.S. Cl. ..... 292/336.3; 292/201; 292/DIG. 62

[58] Field of Search ..... 292/201, 336.3, 347, 292/DIG. 62

[56] References Cited

U.S. PATENT DOCUMENTS

| | | | |
|---|---|---|---|
| 3,039,290 | 6/1962 | Johnstone | 292/201 |
| 3,243,216 | 3/1966 | Peters | 292/201 |
| 4,093,289 | 6/1978 | Inabayashi et al. | 292/DIG. 62 |
| 4,290,634 | 9/1981 | Gelhard | 292/201 |
| 4,674,781 | 6/1987 | Reece et al. | 292/201 |
| 4,762,348 | 8/1988 | Matsumoto | 70/279 |
| 4,793,640 | 12/1988 | Stewart, Sr. | 292/201 |

*Primary Examiner*—Gary L. Smith
*Assistant Examiner*—Michael J. Milano
*Attorney, Agent, or Firm*—Herbert Furman

[57] ABSTRACT

A latch control arrangement includes a transfer lever coupled to the locking lever of a door latch for movement therewith between locked and unlocked positions to place the door latch in its locked or unlocked conditions. A power operator is coupled to the transfer lever. A manual operator is movable from a neutral position to either of a pair of first operating positions to actuate the power operator. Continued movement of the operator from a first operating position to either of a pair of second operating positions mechanically couples the operator to the transfer lever.

4 Claims, 2 Drawing Sheets

LATCH CONTROL ARRANGEMENT

This invention relates generally to a latch control arrangement for vehicle door latches and more particularly a latch control arrangement placing for selectively and alternately a vehicle door latch in either locked or unlocked condition.

The latch control arrangement of this invention is particularly intended for use with known vehicle door latches having a locking lever which is selectively and alternately movable between locked and unlocked positions to thereby selectively and alternately place the door latch in a corresponding locked or unlocked condition.

It is also known to manually move such locking levers between their locked and unlocked positions by an inside control member, such as a garnish button or slide, or by an outside control member, such as a key cylinder. It is further known to move such locking levers between their locked and unlocked positions by a power operator, such as a solenoid or motor, controlled by an inside or outside manually operable switch or such a switch operated by an inside or outside control member.

The latch control arrangement of this invention provides both manual and power movement of the locking member from its locked to its unlocked position by manual movement of a control member in opposite directions from a normal neutral position.

In the preferred embodiment of the invention, a transfer member is coupled to the locking lever of the door latch for movement in unison therewith. A power operator is coupled to the transfer member to move the transfer member and locking lever between their locked and unlocked positions. A manually operable member is resiliently biased to a normal neutral position, and is movable from the neutral position against the resilient bias in one direction to first and second sequential operating positions, and movable in an opposite direction to third and fourth sequential operating positions which respectively correspond to the first and second positions. Movement of the manually operable member from the neutral position to either the first or the third operating position actuates the power operator to move the transfer member and locking lever in unison to either the locked or unlocked position corresponding to this operating position. Should the power operator be inoperable for any reason, movement of the manually operable member from the first to the second operating position, or from the third to the fourth operating position, directly couples the manually operable member and transfer member to thereby manually move the transfer member and locking lever in unison. Thus, the operator need only manually move or operate a single operator to place the door latch in either its locked or unlocked condition.

One feature of this invention is that it provides a latch control arrangement having a single manual operator for placing a vehicle door latch in either locked or unlocked condition. Another feature is that the manual operator normally actuates a power operator for the door latch, but can be directly coupled to the door latch should the power operator be unable to place the door latch in the desired condition. A further feature is that a transfer member is coupled to the locking lever of the door latch and to a power operator, with the manual operator being directly coupled to the transfer member should the power operator be unable to move the transfer member and locking lever.

These and other features of this invention will be apparent from the following specification and drawings wherein.

Figure 1:
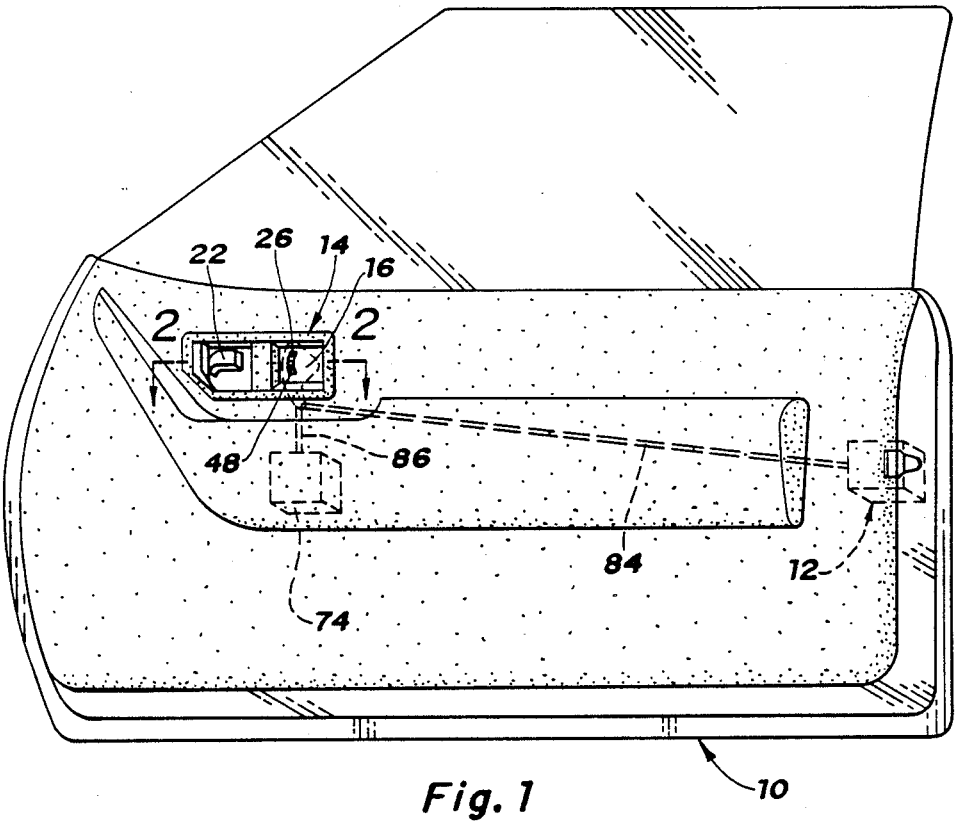
FIG. 1 is a view of a vehicle door embodying a door latch control arrangement according to this invention.

Referring now to FIG. 1 of the drawings, a vehicle door designated generally 10 includes a known vehicle door latch 12 having a locking lever, not shown, which is movable between locked or unlocked positions for placing the door latch 12 in a corresponding locked or unlocked condition. Door latches of this type are known and in current production use by the assignee of this invention. Therefore, no further description of door latch 12 is necessary. A housing 14 is mounted on door 10 in a suitable manner. The rearward portion of housing 14 includes a slightly recessed wall 16 having a further recessed arcuate wall 18 provided with an arcuate slot 20. The forward portion of housing 14 mounts a conventional door handle 22 which is conventionally connected to door latch 12 to release the door latch and permit door 10 to be opened when the locking lever of door latch 12 is in unlocked position and the door latch 12 is in a corresponding unlatched condition.

Figure 6:
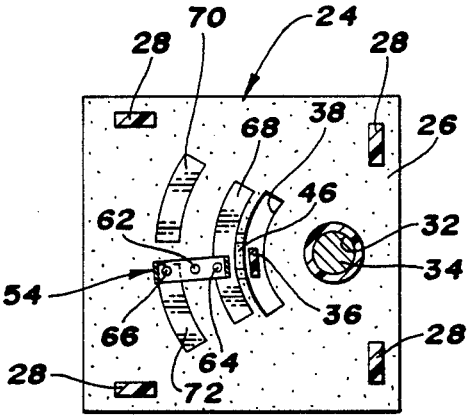
FIG. 6 is a view similar to FIG. 4 showing movement of the transfer member by the power operator.

The latch control arrangement 24 of this invention includes a support or plate 26 of plastic material which is supported in inwardly spaced relationship to wall 16 by four integral posts 28 which extend inwardly from the wall 16 and have shouldered inner ends which are received in slots in the plate 26 and are then heat staked to the plate. A generally triangularly shaped manual operator or lever 30 of plastic material has a flanged aperture 32 at the apex thereof which is received on a shouldered stud 34 extending outwardly through plate 26. The flange of aperture 32 spaces the lever 30 from the plate 26. An integral tab 36 of lever 30 extends inwardly through an arcuate slot 38 of plate 26 which is generated about the axis of stud 34. A coil spring 40 is mounted on the shouldered inner end of stud 34 and has its legs 42 and 44 resiliently engaging the linear sides of tab 36 and an inwardly extending integral arcuate tab 46 of plate 26 which is located immediately adjacent the slot 38. The spring 40 normally locates the lever 30 in a neutral position shown in FIGS. 3 and 4 and in dash lines in FIG. 6 wherein the tab 36 is located equidistant from the ends of the slot 38. The spring 40 resiliently resists movement of the lever 30 from the neutral position in either pivotal direction about the stud 34 to its operating positions, as will be described.

Figure 2:
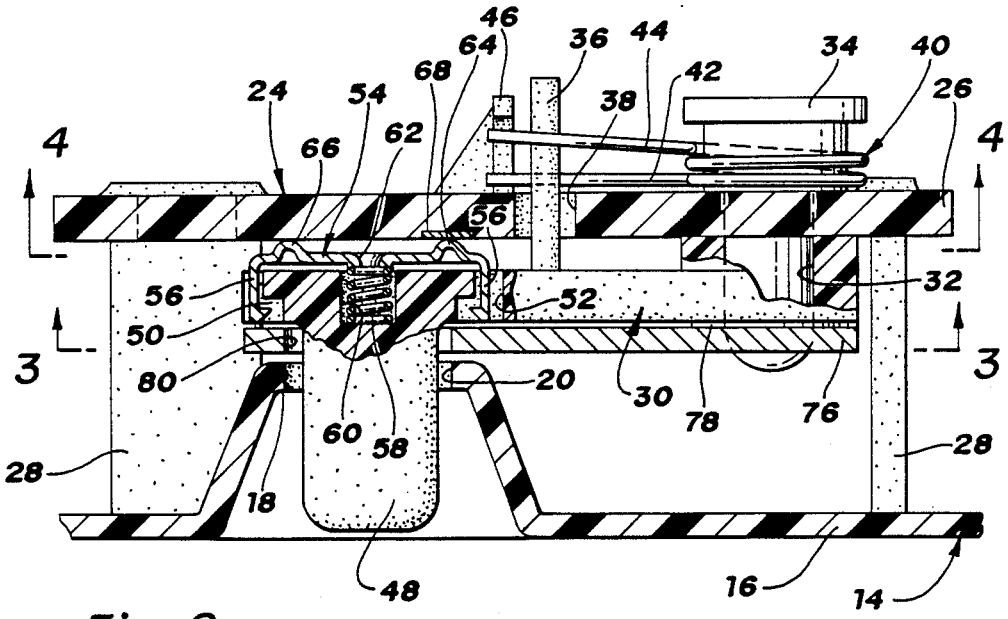
FIG. 2 is an enlarged sectional view taken along line 2—2 of FIG. 1.
Figure 3:
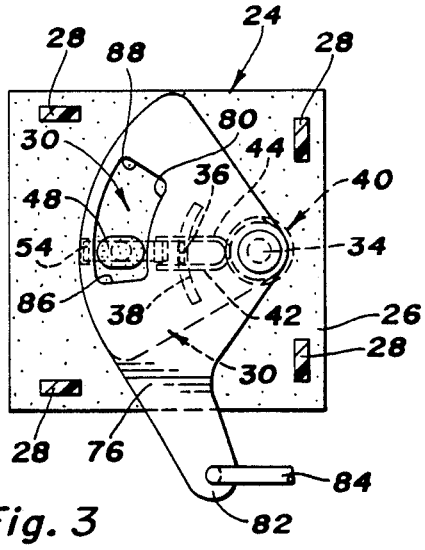
FIG. 3 is a view taken along line 3—3 of FIG. 2.
Figure 4:
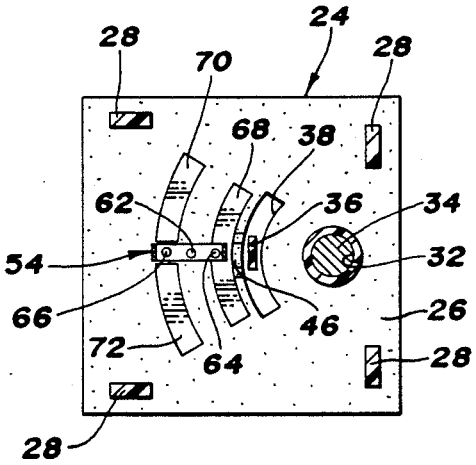
FIG. 4 is a view taken along line 4—4 of FIG. 2.

Lever 30 includes an integral manually graspable button 48 which extends outwardly through the arcuate slot 20, which is generated about the axis of stud 34. The lever 30 also includes a shouldered open slot 50 to one side of the button 48 and a like closed slot 52 to the other side of the button, FIG. 2, with both slots extending through the lever 30. A linear wiping contact 54 has hook shaped ends 56 which are received through the slots 50 and 52 in opposed relationship with the shoulders thereof as shown in FIG. 2 to secure the wiping contact to the lever 30. A coil compression spring 58 has one end seated on the base of a bore 60 of the button 48 and the other end seated on a flanged opening 62 of contact 54 to bias the contact 54 inwardly of lever 30. The contact 54 includes wiping contact buttons 64 and 66. The contact button 64 of contact 54 is resiliently biased into wiping engagement with an arcuate contact strip 68 embedded into the surface of plate 26 and electrically connected in a conventional manner across the vehicle battery. When the lever 30 is in the neutral position, the contact button 66 engages the plate 26 intermediate arcuate contact strips 70 and 72, as shown in FIGS. 3 and 4. The contact strips 70 and 72 are embedded into the surface of the plate 26. The contact strips 70 and 72 are conventionally electrically connected across a power operator 74, such as an electric motor or solenoid, to respectively energize the power operator to rotate or linearly shift in opposite directions. The contact strips 68, 70, and 72 each have integral connector extensions, not shown, which extend outwardly of the inner side of plate 26 for electrical connection purposes.

An intermittent or transfer lever 76 is pivotally mounted on the stud 34 between the head of the stud and a washer 78 which seats against the flange of aperture 32 of the lever 30, FIG. 2. The transfer lever includes an arcuate slot 80 which is coextensive with the slot 20 of recessed wall 18 and receives the button 48 therethrough. A leg 82 of the transfer lever is pivotally connected by a rod 84, FIG. 1, with the locking lever of the door latch 12, and also connected in a suitable manner with the power operator 74. The transfer lever 76 and locking lever 30 move in unison with each other between locked and unlocked positions to place the door latch in its corresponding locked or unlocked condition.

As shown in FIGS. 2, 3, and 4, the lever 30 is normally located in its neutral position by the legs 42 and 44 of spring 40 engaging tab 36 of the lever 30 and tab 46 of the plate 26. This locates the contact button 64 intermediate the ends of the contact strip 68 and locates the contact button 66 on the plate 26 between the contact strips 70 and 72, FIG. 4. The button 48 of the lever 30 is located intermediate the ends of slot 20 and adjacent the lower end wall 86 of the slot 80 of the transfer lever 76. In this position of the transfer lever 76, the locking lever of the door latch is in unlocked position and the door latch 12 is in unlocked condition.

Figure 5:
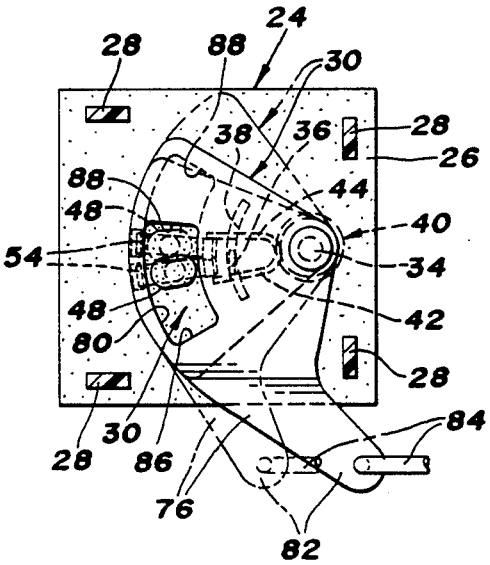
FIG. 5 is a view similar to FIG. 3 showing movement of the transfer member by the power operator.

If it is desired to move the locking lever to locked position to place the door latch 12 in locked condition, the driver or passenger manually grasps the button 48 and moves the button slightly downwardly within slot 20 or counterclockwise from the full line FIG. 3 position and dash line FIG. 5 position to the full line FIG. 5 position against the bias of spring 40 as leg 42 is rotated relative to leg 44. This rotates or pivots the lever 30 slightly about the stud 34, approximately through an arc of 4 degrees. As can be seen from a comparison of FIGS. 4 and 6, this movement of the lever 30 moves the contact button 66 from plate 26 to the contact strip 72 to thereby complete a circuit across the vehicle battery and the power operator 74. The power operator 74 is thus actuated to move the transfer lever 76 counterclockwise from its full line position of FIG. 3 and dash line position of FIG. 5 to its full line position of FIG. 5 and thereby move the locking lever of the door latch 12 to locked position. During movement of the transfer lever 76 from its FIG. 3 position to its FIG. 5 position, the button 48 remains stationary and is not pulled out of the grasp of the operator by movement of the transfer lever 76 since the arcuate slot 80 of the transfer lever 76 permits the transfer lever 76 to move independently of the locking lever 30. Upon manual release of the button 48, the spring 40 returns the button to the full line position of FIG. 3 and dash line position of FIG. 5 intermediate the ends of the slot 20 and again locate the contact button 66 on plate 26 intermediate contact strips 70 and 72. The arc of movement of the lever 30 about stud 34 is very slight and insufficient to engage the button 48 with the lower end wall 86 of slot 80.

Figure 7:
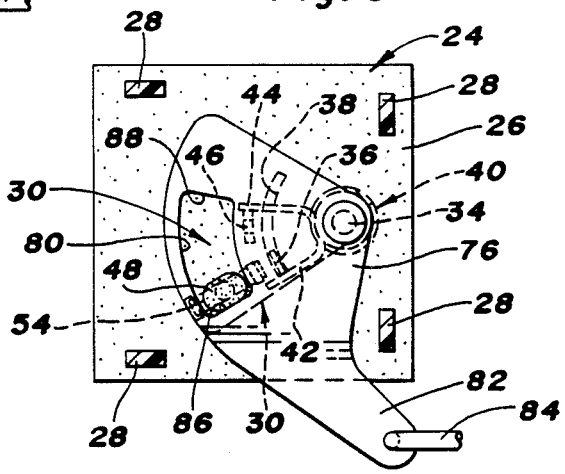
FIG. 7 is a view showing movement of the transfer member by the manual operator when the power operator is unable to move the transfer member.

Should the power operator 74 be inoperable for any reason, the passenger or driver can continue the movement of the button 48 downwardly within the slot 20 past the initial 4 degrees of movement. This causes the button 48 to pick up or engage the end wall 86 of the slot 80, as shown in FIG. 7, to thereafter manually move the transfer lever 76 and the locking lever of door latch 12 in unison to locked position and place the door latch 12 in locked condition. The bias of the spring 40 returns the button 48 to its FIG. 3 position intermediate the ends of slot 20 when the button is manually released.

From the foregoing description, movement of the transfer lever and locking lever in unison from the locked position thereof to the unlocked position is believed apparent. To accomplish this movement, the button 48 is moved upwardly within slot 20, or clockwise as viewed in FIGS. 3 and 4, to move the contact button 66 from plate 26 to contact strip 70 and energize the power operator 74 in the opposite direction than in the previously described example. Should the power operator 74 be inoperable for any reason, continued manual movement of button 48 upwardly within slot 20 will engage the button with the upper end wall 88 of slot 80 to manually move the transfer lever 76 and locking lever 30 to their unlocked position.

Thus this invention provides an improved latch control arrangement having a single control member for controlling both power and manual movement of a locking member of a vehicle door latch between its locked and unlocked positions to selectively and alternately place the door latch in either locked or unlocked condition.

The embodiments of the invention in which an exclusive property or privilege is claimed are defined as follows:

1. In combination with a vehicle door latch having a locking member movable between locked and unlocked positions to place the door latch in locked or unlocked positions, a door latch control arrangement for moving the locking member between its locked and unlocked positions comprising, a support, operating means mounted on the support and coupled to the locking member for moving in unison with the locking member between locked and unlocked positions, power operating means coupled to the operating means for moving the operating means and locking member, a manual operator mounted on the support for movement relative thereto in opposite directions from a neutral position, means normally locating the manual operator in the neutral position, means operable upon movement of the manual operator from the neutral position in either direction to a first operating position for actuating the power operating means to move the operating means and locking member between their positions, and cooperating means on the manual operator and operating means operable upon movement of the manual operator past either first operating position for moving the operating means and locking member in unison between their positions.

2. In combination with a vehicle door latch having a locking member movable between locked and unlocked positions to place the door latch in locked or unlocked positions, a door latch control arrangement for moving the locking member between alternate unlocked and locked positions comprising, a support, operating means mounted on the support and operatively connected to the locking member for moving in unison with the locking member between locked and unlocked positions, power operating means coupled to the operating means for moving the operating means and locking member, a manual operator mounted on the support for movement relative thereto in opposite directions from a neutral position, means normally locating the manual operator in the neutral position, means operable upon movement of the manual operator from the neutral position in either direction to a first operating position for actuating the power operating means to move the operating means and locking member in unison between their positions, and cooperating means on the manual operator and operating means engageable with each other upon movement of the manual operator past either first operating position to mechanically couple the operating means and locking member for movement in unison between their positions.

3. In combination with a vehicle door latch having a locking member movable between locked and unlocked positions to place the door latch in locked or unlocked positions, a door latch control arrangement for either manually or power moving the locking member between alternate unlocked and locked positions comprising, a support, a lever movably mounted on the support and having spaced shoulder means, means operatively connecting the lever to the locking member for moving in unison with the locking member, power operating means coupled to the lever for moving the lever and locking member in unison, a manual operator movably mounted on the support for movement relative thereto in either direction from a neutral position, means normally locating the manual operator in the neutral position, means operable upon movement of the manual operator from the neutral position in either direction to a first operating position for actuating the power operating means to move the transfer lever and locking member in unison, and means on the manual operator engageable with either shoulder means of the transfer lever upon movement of the manual operator past either first operating position to move the transfer lever and locking member in unison between their positions.

4. In combination with a vehicle door latch having a locking member movable between locked and unlocked positions to place the door latch in locked or unlocked positions, a door latch control arrangement for either manually or power moving the locking member between alternate unlocked and locked positions comprising, a support, a transfer lever mounted on the support and having an aperture therethrough, means operatively connecting the transfer lever to the locking member for movement in unison therewith between locked and unlocked positions, power operating means coupled to the transfer lever for moving the transfer lever and locking member in unison, a manually operable lever pivotally mounted on the support for movement relative thereto in one direction from a neutral position to first and second operating positions and in an opposite direction from the neutral position to third and fourth operating positions, means normally locating the manually operable lever in the neutral position, manually graspable means extending through the aperture of the transfer lever for moving the manually operable lever, means operable upon movement of the manually operable lever from the neutral position to either the first or third operating positions for actuating the power operating means to move the transfer lever and locking member in unison between their positions, the manually graspable means engaging the edges of the aperture of the transfer lever for moving the transfer lever and locking member in unison between their positions upon movement of the manually operable member to the second or fourth operating positions.

* * * * *